United States Patent [19]

Yamamoto et al.

[11] Patent Number: 4,947,051

[45] Date of Patent: Aug. 7, 1990

[54] STARTER PROTECTOR FOR AN ENGINE

[75] Inventors: Kyohei Yamamoto; Akira Morishita, both of Himeji, Japan

[73] Assignee: Mitsubishi Denki Kabushiki Kaisha, Tokyo, Japan

[21] Appl. No.: 289,894

[22] Filed: Dec. 27, 1988

[30] Foreign Application Priority Data

Jan. 22, 1988 [JP] Japan ..... 63-12897
Jan. 22, 1988 [JP] Japan ..... 63-7406

[51] Int. Cl.[5] ..... F02N 17/00
[52] U.S. Cl. ..... 290/38 R; 123/179 B
[58] Field of Search ..... 290/38 R, 38 C, 38 E, 290/40 E, DIG. 1, DIG. 3; 123/179 R, 179 A, 179 B

[56] References Cited

U.S. PATENT DOCUMENTS 3,712,283 1/1973 Kiess et al. ..... 123/179 A
4,198,945 4/1980 Eyermann et al. ..... 123/179 B
4,750,583 2/1986 Hamano et al. ..... 123/179 K

FOREIGN PATENT DOCUMENTS 52064 12/1980 Japan .
175765 9/1985 Japan .

*Primary Examiner*—Philip H. Leung
*Assistant Examiner*—W. E. Duncanson, Jr.
*Attorney, Agent, or Firm*—Sughrue, Mion, Zinn, Macpeak & Seas

[57] ABSTRACT

A starter protector for a starter of an engine has a switching circuit which turns the starter off, and a calculating circuit which measures the frequency of ripples which are superimposed on either the terminal voltage or the terminal current of the starter and controls the switching circuit so as to turn off the starter when the frequency exceeds a prescribed value. In another form of the invention, a calculating circuit counts the number of ripples which are superimposed on the terminal voltage or terminal current of the starter and controls the switching circuit to turn off the starter when the number of ripples exceeds a prescribed value.

6 Claims, 5 Drawing Sheets

STARTER PROTECTOR FOR AN ENGINE

BACKGROUND OF THE INVENTION

This invention relates to a starter protector for the engine of an automobile. More particularly, it relates to a starter protector which can turn off a starter immediately or soon after an engine has started.

A starter protector is a device which prevents the starter motor from operating for extending periods of time which could damage the starter motor by burning. Various types of starter protectors have been proposed in the past. For example, Japanese Published Examined Utility Model Application No. 55-52064 discloses a starter protector which turns a starter motor off based on the value of the terminal voltage of a battery which powers the starter motor. When a starter motor begins to operate, the terminal voltage of the battery undergoes a sudden decrease due to the large current which flows into the starter. After the engine has started and is running under its own power, the load on the starter motor decreases, so the battery terminal voltage increases towards its initial level. In that invention, the battery terminal voltage is compared with a reference voltage, and when the battery terminal voltage exceeds the reference voltage, it is determined that the engine has started and the supply of power to the starter motor is cut off.

However, in that invention, if the capacity of the battery should considerably decrease during cranking, the battery terminal voltage may fail to rise above the reference voltage after the engine has started, so current will continue to be supplied to the starter motor even after the engine has started, possibly resulting in burning damage.

Furthermore, the reference voltage gradually decreases over time, so if the starter is operated for a long period of time, due to the decrease in the reference voltage, it is possible for the battery terminal voltage to exceed the reference voltage and for the starter motor to be turned off before it has had a chance to start the engine.

In addition, that invention has the problem that the accuracy of starter control varies in accordance with factors such as the condition of the battery, the air temperature, and the condition of the engine.

Japanese Published Unexamined Patent Application No. 60-175765 discloses a protection device for preventing a starter from being overrun by an engine. When a starter motor is operating, ripples are superimposed on the terminal voltage and the terminal current of the starter. The amplitude (the difference between the maximum and minimum extremes) of these ripples is smaller after the engine has started and the engine is overrunning the starter than when the engine is being cranked. In that invention, the amplitude of the ripples of either the terminal voltage or the terminal current is measured, and when the magnitude falls below a reference value, it is determined that the engine has started, so the starter is turned off. However, the amplitude of the ripples is affected by the condition of the battery, by the condition of the charging generator, and by noise, so that invention is difficult to implement.

Another conventional starter protector employs a timer which automatically cuts off the supply of current to a starter after a prescribed length of time. However, as the length of time which is required for an engine to start depends on various factors, it is difficult to select the prescribed length of time for which the starter is allowed to operate. If the prescribed length of time before the timer shuts the starter off is too long, the starter will be overrun by the engine for a considerable length of time in those instances when the engine starts right away. On the other hand, if the prescribed length of time is too short, in those instances when it is difficult to start the engine, the timer will shut the starter off before it has been able to start the engine.

SUMMARY OF THE INVENTION

Accordingly, it is an object of the present invention to provide a starter protector for an automobile engine which is not influenced by factors such as the condition of the battery, the engine condition, and the temperature.

It is another object of the present invention to provide a starter protector for an automobile engine which can turn off a starter immediately or soon after the engine has started.

It is yet another object of the present invention to provide a starter protector which can prevent a starter from being operated for excessive lengths of time when the engine is difficult to start.

As mentioned above, when a starter motor is operating, a ripple is superimposed on both the terminal voltage and the terminal current of the starter. The frequency of this ripple is lower during cranking of the engine than after the engine has started and is overrunning the starter. By measuring the frequency of this ripple, it is possible to immediately detect when the engine has started and then cut off the current to the starter. As a result, the starter can be protected from burning damage due to operating for excessively long periods.

The frequency of the ripple is not influenced by factors such as the battery condition or the engine condition, so by utilizing the frequency of the ripples, it is possible to perform highly accurate control of a starter.

In accordance with one mode of the present invention, a starter protector comprises a switching circuit which cuts off the supply of current to a starter and a calculating circuit which determines when the frequency of the ripple which is superimposed on either the terminal voltage or the terminal current of a starter has exceeded a predetermined frequency and controls the switching circuit to shut off the starter when the predetermined frequency has been exceeded.

In accordance with another mode of the present invention, a starter protector comprises a switching circuit which cuts off the supply of current to a starter and a calculating circuit which determines when the number of ripples which are superimposed on either the terminal voltage or the terminal current of a starter has exceeded a predetermined number and controls the switching circuit to shut off the starter when the predetermined number has been exceeded. In this mode of the invention, not only can a starter be turned off soon after an engine has started, but the starter can be automatically turned off when it has operated for a certain length of time without starting the engine.

BRIEF DESCRIPTION OF THE DRAWINGS

In the figures, the same reference numerals indicate the same or corresponding parts.

DESCRIPTION OF THE PREFERRED EMBODIMENTS

Figure 1:
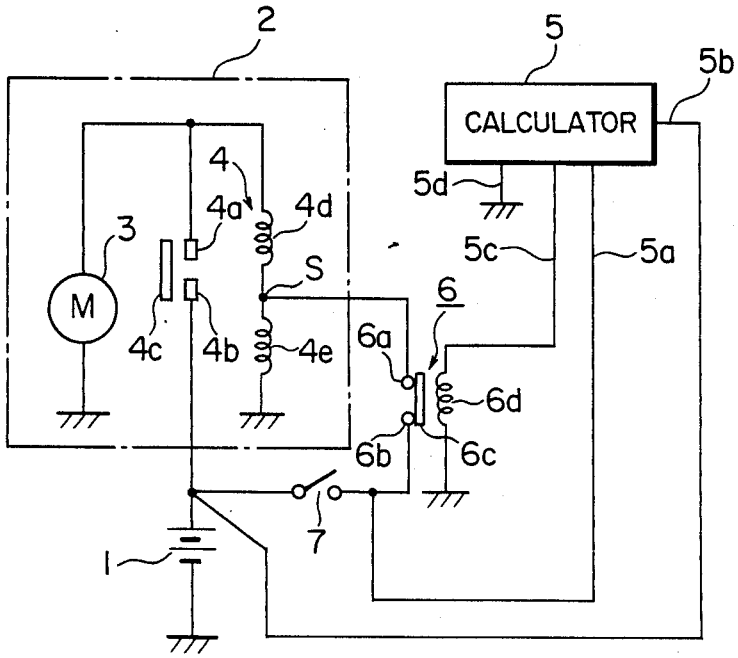
FIG. 1 is a circuit diagram of a first embodiment of a starter protector in accordance with the present invention.

Hereinbelow, a number of preferred embodiments of the present invention will be described while referring to the accompanying drawings, FIG. 1 of which is a circuit diagram of a first embodiment. As shown in this figure, a conventional starter 2 of an automotive engine is powered by the battery 1 of an automobile. The starter 2 comprises a starter motor 3 and a solenoid switch 4. The starter motor 2 has an unillustrated output shaft on which is mounted an unillustrated pinion. The pinion engages with an unillustrated ring gear on the flywheel of the engine. The solenoid switch 4 has two fixed contacts 4*a* and 4*b* and a movable contact 4*c* which is normally open. Fixed contact 4*a* is connected to ground through an exciting coil comprising a current coil 4*d* and a voltage coil 4*e* which are connected in series to one another at point S. Fixed contact 4*a* is also connected to the positive terminal of the starter motor 3. The movable contact 4*c* closes when a voltage is applied to point S.

A relay 6 has two fixed contacts 6*a* and 6*b* and a movable contact 6*c* which is normally closed. Fixed contact 6*a* is connected to point S of the solenoid switch 4, while fixed contact 6*b* is connected to the positive terminal of the battery 1 through a start switch 7. The movable contact 6*c* is opened when a current passes through an exciting coil 6*d* of the relay 6. The relay constitutes a switching circuit for cutting off the supply of current to the starter 2.

The relay 6 is controlled by a calculating circuit 5. Power is supplied to the calculating circuit 5 by a power supply line 5*a* which is connected to one side of the start switch 7. The voltage of the battery 1 is applied to the calculating circuit 5 as an input signal via an input signal line 5*b*. The calculating circuit 5 supplies current to the exciting coil 6*d* of the relay 6 via an output signal line 5*c* when the exciting coil 6*d* is to be energized. The calculating circuit 5 is also connected to ground by a ground line 5*d*.

Figure 2:
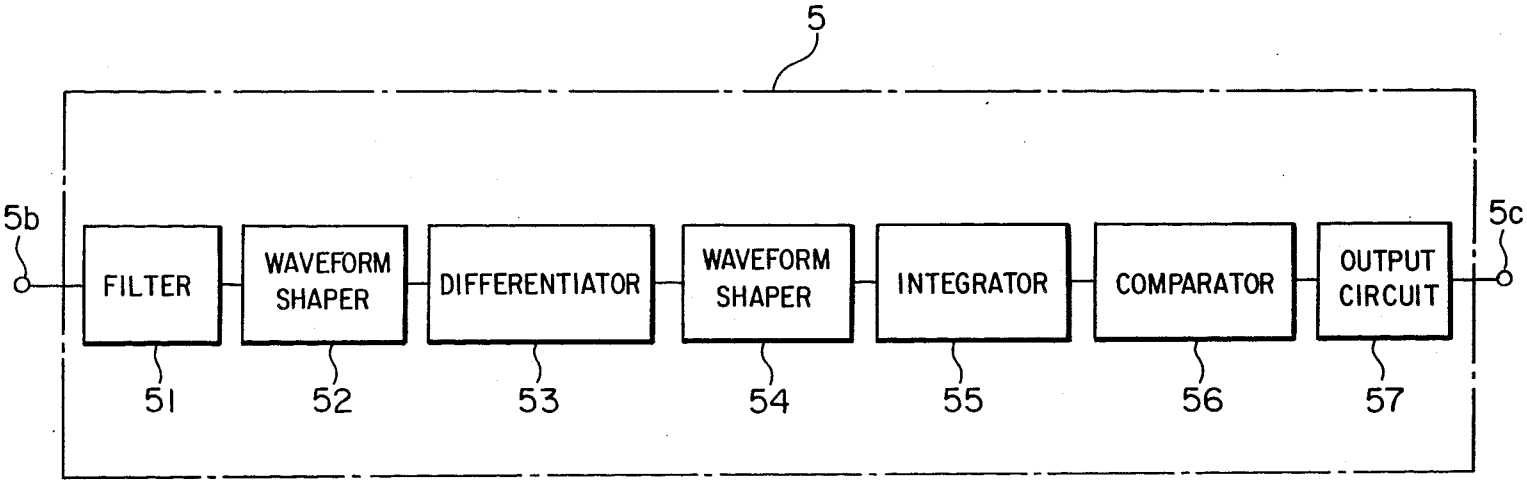
FIG. 2 is a block diagram of the calculating circuit of FIG. 1.

FIG. 2 schematically illustrates the structure of the calculating circuit 5. A band-pass filter 51, a waveform shaper 52, a differentiator 53, another waveform shaper 54, an integrator 55, a voltage comparator 56, and an output circuit 57 are connected with one another in series between the input signal line 5*b* and the output signal line 5*c*. The operation of each of these elements will be described further below.

Figure 3:
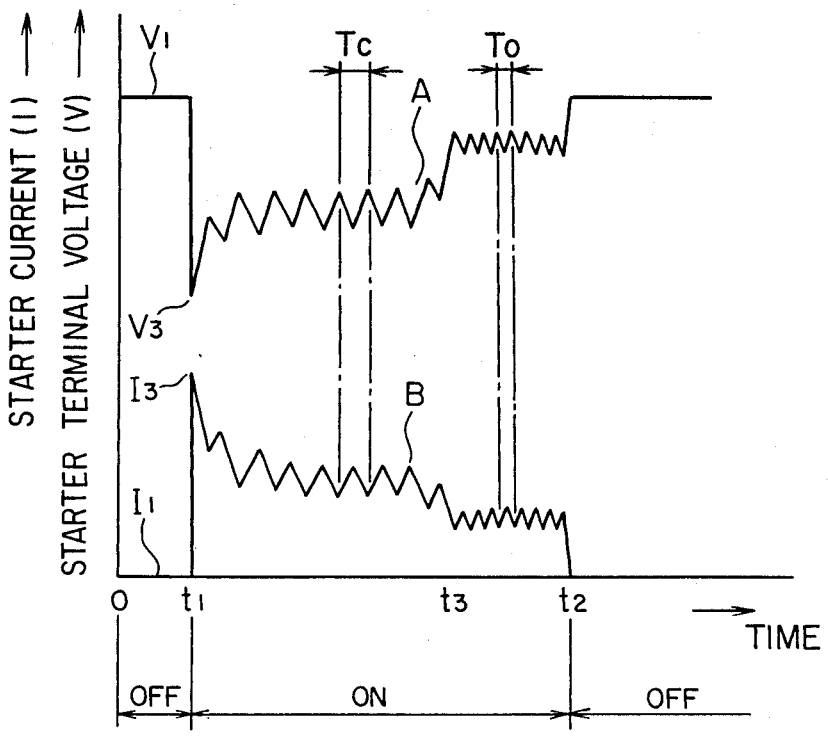
FIG. 3 is a waveform diagram showing the waveforms of the terminal voltage and the terminal current of a starter during cranking of an engine and when the starter is being overrun by the engine.

FIG. 3 is a graph of the terminal voltage V (waveform A) and the terminal current I (waveform B) of the starter 2 as a function of time during the operation of the starter 2. Between time 0 and time $t_1$, the starter 2 is off, so the terminal voltage is $V_1$ and the terminal current is $I_1=0$.

At time $t_1$, the starter 2 is turned on, and a large inrush current $I_3$ flows into the starter 2. The magnitude of the inrush current is determined by the internal resistance of the starter 2 and the battery 1, the resistance of wiring, and other parameters. As a result of the inrush current, the terminal voltage suddenly drops to $V_3$. From time $t_1$, the rotational speed of the starter motor 3 increases, so the terminal current gradually falls and the terminal voltage gradually rises.

Between time $t_1$ and $t_3$, the engine is being cranked by the starter 2. At time $t_3$, the engine starts and begins to run under its own power. Once the engine starts, its rotational speed increases. This decreases the load on the starter motor 3, so the terminal voltage increases and the terminal current decreases from the levels prior to time $t_3$. At time $t_2$, the starter 2 is turned off, so the terminal current drops to 0 and the terminal voltage returns to $V_1$.

It can be seen that a large alternating component, referred to as ripple, is superimposed upon the terminal voltage and the terminal current of the starter. During cranking, the ripple has a period of Tc, and after the engine has started, it has a period of To. This ripple is caused by the difference in the mechanical load on the starter motor 3 between ignition and compression of the engine. During compression of the engine, the torque which must be supplied by the starter motor 3 is greater than during ignition, so the starter terminal current increases during compression and falls during ignition. The opposite is the case for the terminal voltage. The frequency of the ripple thus corresponds to the rotational speed of the engine. Since the engine speed is lower during cranking than after the engine has started, the period Tc of the ripple during cranking is much longer than the period To of the ripple when the engine has started. Generally, Tc is several times longer than To, so the frequency of the ripples after the engine has started (1/To) is several times higher than the frequency during cranking (1/Tc).

The present invention utilizes the frequency of the ripples which is superimposed on either the terminal voltage or the terminal current as an indication of whether the engine has started or not. As soon as the frequency of the ripples exceeds a certain level, it is determined that the engine has started, and the starter 3 is turned off. From FIG. 3, it can be seen that the ripples which are superimposed on the terminal voltage have a different amplitude from the ripples which are superimposed on the terminal current and that the two sets of ripples are 180° out of phase with one another. However, at any given time, the period of the ripples on the terminal voltage is identical to the period of the ripples on the terminal current. Therefore, it does not matter which set of ripples is measured to determine the frequency of the ripples.

Next, the operation of this embodiment will be described for the case in which the frequency of the starter terminal voltage is measured. Referring again to FIGS. 1 and 2, first, the starter 2 is actuated by closing the start switch 7. When the start switch 7 is closed, current is supplied to point S of the solenoid switch 4 through the movable contact 6c of the relay 6 which is in its normal closed position. This current energizes the current coil 4d and the voltage coil 4e, and magnetic force generated by the exciting coils closes the movable contact 4c of the solenoid switch 4. The closing of contact 4c connects the starter motor 3 to the battery 1. The unillustrated pinion is made to engage with the ring gear of the engine flywheel, and the starter motor 3 begins to rotate and crank the engine.

The starter terminal voltage is input to the calculating circuit 5 via input signal line 5b. The input signal is first filtered by the band-pass filter 51. The filter 51 removes the direct current component and noise (such as noise due to commutation sparks) from the input signal and produces an output signal containing only the ripple which was superimposed on the terminal voltage. The ripple is then passed through waveform shaper 52 which converts the ripple into pulses. The pulses are differentiated by differentiator 53, and the differentiated output is converted back into pulses by waveform shaper 54. In this manner, pulses having a frequency which accurately corresponds to that of the original ripples can be produced, regardless of the magnitude of the ripples. The integrator 55 integrates the pulses which are output by waveform shaper 54 over a prescribed length of time and then is reset. It produces an output voltage which corresponds to the frequency of the pulses input thereto during the prescribed length of time for which integration is performed. Thus, the output of the integrator 55 corresponds to the frequency of the ripples. The integrator 55 therefore performs frequency-voltage conversion. The output voltage of the integrator 55 is input to the comparator 56, which compares this voltage with a predetermined reference voltage which corresponds to a frequency of (1/To), which is the frequency of the ripple of the terminal voltage when the engine has started. If the voltage which is input to the comparator 56 by the integrator 55 exceeds the reference voltage, the output circuit 57 produces an output signal which energizes coil 6d of the relay 6 via output signal line 5c. Otherwise, the output circuit 57 produces no signal and the coil 6d remains unenergized.

When coil 6d is energized, it opens the movable contact 6c, and the supply of current to the exciting coils 4d and 4e of the solenoid switch 4 is cut off. This causes the movable contact 4c to return to its normal open position, and the supply of current from the battery 1 to the starter motor 3 is cut off. At the same time, the solenoid switch 4 disengages the unillustrated pinion of the starter motor 3 from the ring gear of the flywheel of the engine.

As a result, the starter 2 is turned off as soon as the engine has started, and the engine is prevented from overrunning the starter 2. Accordingly, burning damage to the starter motor 3 due to conducting for long periods of time while it is being overrun can be completely prevented.

In FIG. 1, the power supply line 5a is connected to the start switch 7, but it is possible to instead connect it to the positive terminal of the battery 1 or to the on position of the starting key. However, it is preferable to connect the power supply line to the start switch 7 since this eliminates ripple caused by the starter motor 3 which could produce undesirable effects if the power supply line 5a is connected directly to the battery 1.

Figure 4:
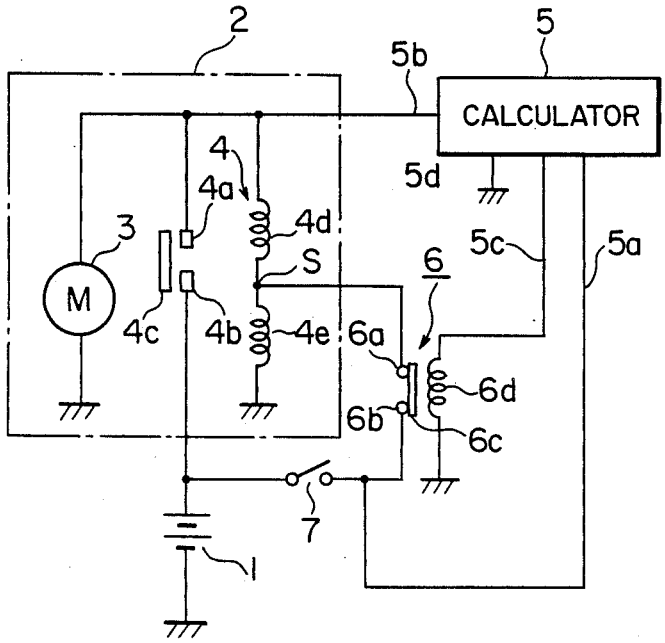
FIG. 4 is a circuit diagram of a second embodiment of the present invention in which the input signal line of the calculating circuit 5 is connected to the solenoid switch 4.

FIG. 4 illustrates a second embodiment of the present invention in which the input signal wire 5b is connected to fixed contact 4a of the solenoid switch 4 of the starter 2. With this arrangement, in the same manner as described above, undesirable effects due to ripple caused by the starter motor 3 can be eliminated. This embodiment is otherwise identical to that of FIG. 1 and it provides the same benefits.

Figure 5:
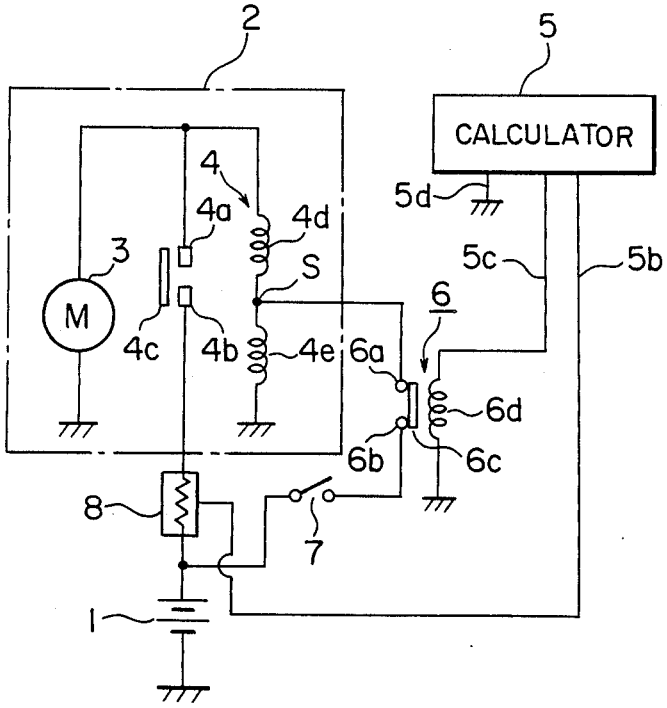
FIG. 5 is a circuit diagram of a third embodiment of the present invention in which the frequency of ripples superimposed on the terminal current of the starter is measured.

FIG. 5 illustrates a third embodiment of the present invention in which the frequency of the ripple which is superimposed on the terminal current of the starter 2 is measured. A shunt 8 for detecting current is connected between the positive terminal of the battery 1 and fixed contact 4b of the solenoid switch 4. The input signal wire 5b of the calculating circuit 5b is connected to the shunt 8. The calculating circuit 5 determines the frequency of the ripple in the signal which is input thereto in exactly the same manner as in the previous embodiment, and when the frequency exceeds a predetermined value, the starter 2 is turned off. The structure of this embodiment is otherwise identical to that of the embodiment of FIG. 1.

Figure 6:
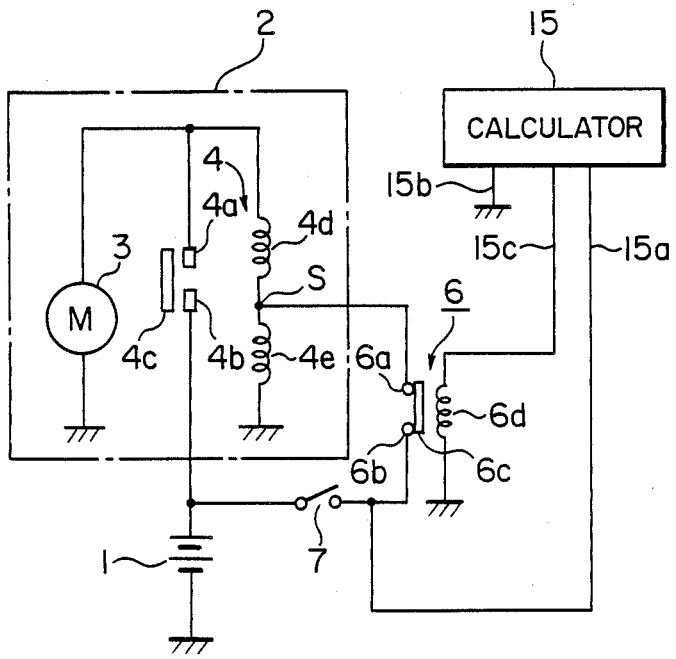
FIG. 6 is a circuit diagram of a fourth embodiment of the present invention in which the number of ripples superimposed on the terminal voltage of the starter is counted.

FIG. 6 illustrates a fourth embodiment of the present invention in which the starter 2 is turned off when the number of ripples which are superimposed on the starter terminal voltage exceeds a prescribed value. The structure of this embodiment is similar to that of the embodiment of FIG. 1 except that the calculating circuit 5 of FIG. 1 is replaced by a calculating circuit 15 which counts ripples. The calculating circuit 15 has an input signal line 15a which is connected to the start switch 7, a ground line 15b which is connected to ground, and an output signal line 15c which provides current to the exciting coil 6d of the relay 6.

The terminal voltage of the starter 2 is input to the calculating circuit 15 via the input signal line 15a, and the calculating circuit 15 counts the number of ripples which are superimposed on the terminal voltage. When the number of pulses exceeds a predetermined value, the calculating circuit 15 excites the exciting coil 6d of the relay via the output signal line 15c, the starter 2 is turned off, and the pinion of the starter 2 is disengaged from the ring gear of the engine as in the previous embodiments.

Circuits for counting ripples are well known in the art, and any conventional such circuit can be employed as the calculating circuit 15. The calculating circuit 5 of FIG. 2 which is used to determine frequency can be adapted to function as a circuit for counting ripples by having the integrator 55 perform continuous integration instead of resetting it after a prescribed length of time.

By counting the number of ripples and shutting off the starter 2 when a prescribed level has been exceeded, this embodiment of a starter protector is able to prevent the starter 2 from being overrun by the engine for long periods of time, and it is also able to prevent the starter 2 from conducting for long periods of time when the engine is difficult to start.

For example, if the period Tc of each ripple of the terminal voltage is 0.2 seconds during cranking, the period To of each ripple is 0.04 seconds after the engine has started, and the calculating circuit 15 is set to turn off the starter 2 after counting 100 ripples, if the engine is cranked but does not start, the calculating circuit 15 will turn off the starter 2 after (100 ripples $\times$0.2 seconds per ripple)=20 seconds, and the starter 2 will be prevented from running for too long. On the other hand, if the engine should start immediately, the starter 2 will be turned off after (100 ripples $\times$0.04 seconds per ripple)=4 seconds, so the engine will be prevented from overrunning the starter 2 for long periods of time. Thus, whether the engine starts soon or not at all, the starter 2 can be protected from burning damage due to conducting for too long.

In the embodiment of FIG. 6, the number of ripples which are superimposed on the terminal voltage are counted. However, it is instead possible to count the number of ripples which are superimposed on the terminal current by connecting the input signal line 15*b* to a shunt 8 which is connected between the battery 1 and fixed contact 4*b* of the solenoid switch 4 in a manner similar to that shown in FIG. 5.

In the above-described embodiments, the members which constitute the starter protector are separate from the starter 2 itself, but it is possible to combine the starter protector and the starter 2 into a single device.

What is claimed is:

1. A starter protector for an engine comprising:

a switching circuit which is connected between a battery and a starter of an engine; and a calculating circuit which measures the frequency of ripples which are superimposed on a component of the flow of power to the starter from the battery and which controls said switching circuit so as to cut off the supply of power from the battery to the starter when the frequency of the ripples that are measured exceeds a prescribed value.

2. A starter protector for an engine as claimed in claim 1 wherein:

the starter comprises a starter motor and a solenoid switch, the solenoid switch comprising an exciting coil and a movable contact which is connected between the starter motor and the battery, the movable contact being closed only when the exciting coil is energized;

said switching circuit comprises a relay having an exciting coil and a movable contact which is open only when said exciting coil is energized, the movable contact of said switching circuit being connected between the battery and the exciting coil of the solenoid switch of the starter; and said calculating circuit includes an output circuit for energizing said exciting coil of said relay when the frequency of the ripples exceeds the prescribed value.

3. A starter protector for an engine comprising:

a switching circuit which is connected between a battery and a starter of an engine; and a calculating circuit which counts the number of ripples which are superimposed on a component of the flow of power to the starter from the battery and which controls said switching circuit so as to cut off the supply of power from the battery to the starter when the number of ripples that are counted exceeds a prescribed value.

4. A starter protector for an engine as claimed in claim 3 wherein:

the starter comprises a starter motor and a solenoid switch, the solenoid switch comprising an exciting coil and a movable contact which is connected between the starter motor and the battery, the movable contact being closed only when the exciting coil is energized;

said switching circuit comprises a relay having an exciting coil and a movable contact which is open only when said exciting coil of said switching circuit is energized, said movable contact of said switching circuit being connected between the battery and the exciting coil of the solenoid switch of the starter; and said calculating circuit includes an output circuit for energizing said exciting coil of said relay when the number of ripples exceeds the prescribed value.

5. A starter system for an engine comprising:

a battery;

a starter motor;

a solenoid switch having an exciting coil and a movable contact which is closed only when said exciting coil is energized, said movable contact being connected between said starter motor and said battery;

a start switch;

a relay having an exciting coil and a movable contact which is connected between the exciting coil of said solenoid switch and said battery via said start switch, the movable contact of said relay being open only when the exciting coil of said relay is energized; and a calculating circuit which measures the frequency either of ripples which are superimposed on the terminal voltage of the starter or of ripples which are superimposed on the terminal current of the starter and which energizes said exciting coil of said relay when the frequency of the ripples that are measured exceeds a prescribed value.

6. A starter system for an engine comprising:

a battery;

a starter motor;

a solenoid switch having an exciting coil and a movable contact which is closed only when said exciting coil is energized, said movable contact being connected between said starter motor and said battery;

a start switch;

a relay having an exciting coil and a movable contact which is connected between the exciting coil of said solenoid switch and said battery via said start switch, the movable contact of said relay being open only when the exciting coil of said relay is energized; and a calculating circuit which counts the number of ripples which are superimposed on the terminal voltage of the starter or the number of ripples which are superimposed on the terminal current of the starter and which energizes said exciting coil of said relay when the number of ripples that are counted exceeds a prescribed value.

* * * * *